US006810534B2

(12) United States Patent
Durkin et al.

(10) Patent No.: US 6,810,534 B2
(45) Date of Patent: Nov. 2, 2004

(54) TARGETED PROTECTIVE CLOTHING PATCH

(76) Inventors: William Noon Durkin, 440 Paradise Isle Blvd., Hallandale, FL (US) 33009; Diane M. Ferrara, 413 Main St., East Greenwich, RI (US) 02818

( * ) Notice: Subject to any disclaimer, the term of this patent is extended or adjusted under 35 U.S.C. 154(b) by 0 days.

(21) Appl. No.: 10/727,652

(22) Filed: Dec. 5, 2003

(65) Prior Publication Data

US 2004/0143887 A1 Jul. 29, 2004

Related U.S. Application Data

(63) Continuation-in-part of application No. 09/839,372, filed on Apr. 23, 2001, now abandoned.

(51) Int. Cl.[7] ..... A41D 27/26

(52) U.S. Cl. ..... 2/267; 2/455

(58) Field of Search ..... 2/227, 228, 24, 2/81, 16, 22, 23, 465, 467, 79, 93, 69, 456, 267, 115, 455, 122; 450/86, 92, 53–56; 602/41, 46, 61, 62; 428/102

(56) References Cited

U.S. PATENT DOCUMENTS

| | | | | | |
|---|---|---|---|---|---|
| 1,654,452 | A | * | 12/1927 | Bradley | 2/227 |
| 2,101,607 | A | * | 12/1937 | Block | 156/94 |
| 2,568,083 | A | * | 9/1951 | Mitchell | 2/231 |
| 4,035,844 | A | * | 7/1977 | Atack et al. | 2/466 |
| 4,441,211 | A | * | 4/1984 | Donzis | 2/459 |
| 4,507,801 | A | * | 4/1985 | Kavanagh et al. | 2/462 |
| 4,613,991 | A | * | 9/1986 | Grover | 2/23 |
| 4,831,666 | A | * | 5/1989 | Denman | 2/23 |
| 4,920,577 | A | * | 5/1990 | Scharf | 2/24 |
| 5,038,408 | A | * | 8/1991 | DeBaene | 2/23 |
| 5,133,088 | A | * | 7/1992 | Dunlap | 2/241 |
| 5,210,877 | A | * | 5/1993 | Newman | 2/456 |
| D336,548 | S | * | 6/1993 | Zeller | D29/121.1 |
| 5,219,367 | A | * | 6/1993 | Fields | 2/227 |
| 5,271,101 | A | * | 12/1993 | Speth et al. | 2/228 |
| 5,507,681 | A | * | 4/1996 | Smith et al. | 450/86 |
| 5,551,082 | A | * | 9/1996 | Stewart et al. | 2/465 |
| 5,555,564 | A | * | 9/1996 | Welch | 2/239 |
| 5,569,345 | A | * | 10/1996 | Kenyon | 156/93 |
| 5,689,836 | A | * | 11/1997 | Fee et al. | 2/465 |
| 5,732,412 | A | * | 3/1998 | Holden | 2/23 |
| 5,845,335 | A | * | 12/1998 | Twitty | 2/80 |
| 5,896,580 | A | * | 4/1999 | Aldrich et al. | 2/24 |
| 5,896,583 | A | * | 4/1999 | Grilliot et al. | 2/81 |
| 5,918,319 | A | * | 7/1999 | Baxter | 2/455 |
| 5,920,902 | A | * | 7/1999 | Crampton | 2/24 |
| 6,009,565 | A | * | 1/2000 | Carrington | 2/455 |
| 6,049,906 | A | * | 4/2000 | Aldridge | 2/23 |
| 6,195,809 | B1 | * | 3/2001 | Garcia | 2/455 |
| 6,347,405 | B1 | * | 2/2002 | Boyko | 2/62 |
| 6,425,135 | B1 | * | 7/2002 | Aldrich | 2/23 |
| 2004/0078873 | A1 | * | 4/2004 | Goodwin | 2/267 |

* cited by examiner

*Primary Examiner*—John J. Calvert
*Assistant Examiner*—Alissa L. Hoey
(74) *Attorney, Agent, or Firm*—Cristina M. Offenberg, Esq.

(57) ABSTRACT

A protective clothing patch for cushioning high impact body parts of a person wearing clothing. The protective clothing patch having a lightweight flexible cushion member and a parabolic shaped outer sheath. This outer sheath gives the patch its unique appearance as a modified football shape. The sheath covers high impact cushioning, in a parabolic form, which aids in its ability to conform the natural contour of the high impact body part such as the elbow, shin, shoulder, knee or buttocks. The protective clothing patch is permanently adhered by the user to clothing in the area desired to be protected from high impact. When the person comes into contact with the floor or ground the cushion member will better comfort the knees, elbows or buttocks. The protective clothing patch is durable, flexible and lightweight and it protects the garment from usual wear and tear and thereby extends the lifespan of the garment.

3 Claims, 5 Drawing Sheets

TARGETED PROTECTIVE CLOTHING PATCH

This is a continuation in part of application Ser. No. 09/839,372, filed Apr. 23, 2001, now abandoned.

BACKGROUND OF THE INVENTION

The instant invention relates generally to protective, cushioned, iron-on patches for articles of clothing; and more specifically it relates to a protective clothing patch for the elbows, knees, shins, shoulder, buttocks, or any body part.

Children need protection while running, rollerblading, skateboarding, riding bikes and scooters or when just plain playing and "rough-housing". Gardeners often kneel or sit for long periods of time which can be painful on the knees or buttocks. Recreational sports enthusiasts of all ages are subject to scrapes and abrasions and are in need of proper protection for the vulnerable body parts. Many workmen also need protection for their knees while performing their jobs such as roofers, tile installers, and floor installers. Cushioned protection minimizes impact to the knees and bones. These types of activities are also rough on the garments. The material tends to wear easily on knees, elbows, and buttocks because of abrasion against hard surfaces. Once the garment has holes created in high use areas, the garment must be repaired or thrown away. This protective patch is preventive maintenance in that the garment is prevented from acquiring holes because the patch is durable enough to withstand constant use. As the patch is affixed to the outside or exterior portion of the garment, no holes are created.

The subject invention is a cushioned, iron-on clothing patch for the vulnerable body parts made with a more functional design. The tough, durable and lightweight, practical design and targeted application assure that clothing remains versatile enough to wear for normal everyday use as well as for effective targeted protection or the abrasion areas.

The patch protects the clothing from wearing out in the heavily used areas and extends the lifespan of the garment. The subject invention is parabolic in shape and consists of two layers that are durable and lightweight. The shape and materials lends the pad to be flexible and versatile to be used on a variety of body parts.

There are many existing pads and protective clothing to protect the knee area. Many of the prior art patches are used after the garment has holes and is used to cover it up but with the present invention, the holes are never created. Additionally, many prior art inventions require active participation by the used to put on the pads each time before a job is performed or before playing a sport. Users tend to forget or are too lazy to put the pads on each time and therefore forego the protection. Other pads are pre-affixed in a particular location prior to purchase of the garment. These types of pads are not always effective as the pad may not be in the correct location as different persons are made of different heights and sizes. Lastly, other products are found which are too stiff or heavy to be versatile to place in any location. In order to make the pad protective to prevent tearing or wearing, some of the other prior art patches are made of several layers of material and thereby have created a stiff and heavy pad that is not flexible and versatile for a variety of body part protection.

U.S. Pat. No. 2,572,360, is a preformed injury pad consisting of a flexible semi-cylindrical body section having a flexible quadrispherical end section. An inelastic fabric facing is attached only to the entire outer surface of the semi-cylindrical body section.

Shelby, James E. Illustrates a Knee Pad Attachment in U.S. Pat. No. 4,723,322 the knee pad is for use on a supporting surface, and not attached to a person's knee, to provide support and cushioning to a person's knee. The pad has a lower region having a bottom for contacting the supporting surface, and a contoured upper region for contacting the front portion of the person's knee. The bottom has a frictional surface to resist sliding with respect to the supporting surface. Various properties of the upper region, relating to its contours and fitting with respect to the knee, are disclosed, particularly a concavity in the top of the pad. The concavity may be vacant. The top of the concavity may adjoin the top of the pad. The concavity may have a secondary inner concavity perimeter. The pad may have a plurality of outer perimeters, defining decreasing areas within the perimeters, from bottom to top of the pad.

The patent of Denman, Robert Z., a garment especially adapted for protecting the knees while gardening is disclosed in U.S. Pat. No. 4,831,666 A garment or pant specifically adapted for providing protection to a person's knees in a kneeling position while performing gardening or like chores is disclosed. The garment has a pair of legs, and a pocket affixed to the exterior of each leg. A padded cushioning member is substantially fixedly held in each pocket. The pockets are affixed to the legs in such positions that the pockets and the cushioning member register in the appropriate positions, to provide a cushioning and insulating barrier between the wearer's knees and the ground when the wearer is in kneeling position.

Ritter, William H., has disclosed a Knee Protector in U.S. Pat. No. 4,893,355 A knee protector covers the front of the knee, and extends rearwardly on both sides to protect against mechanical damage to the knee. The protector has foamed padding towards the leg for both comfort and mechanical protection, and a somewhat rigid outer shell to provide strength. For comfort as the leg is flexed, the front of the knee protector has a line about which the rigid shell can move, so that two sections of the shell are articulated, allowing movement in all directions. One side of the knee protector can be shortened to allow the use of a knee splint in conjunction with the knee protector.

Grimm, Thomas M., has disclosed a Knee Pad in U.S. Pat. No. 5,309,570 A knee pad includes a base member which, when unassembled, is planar. A top member is operatively connected to the base member. In a preferred embodiment, the top member is also, when unassembled, planar. The base member has first and second points of attachment and, when unassembled, are at a first distance from each other. The top member has first and second points of attachment which, when unassembled, are also a first distance from each other. Provided are means for securing the top member to the base member at the points of attachment wherein, when assembled, the first and second points of attachment of the base member are at a second distance from each other. The second distance is less than the first distance wherein the base member forms a cupped region. Also provided is a means for attaching the base and top members to a user's knee.

Zeller, Marvin invented the Detachable Knee Pad as shown in U.S. Pat. No. Des. 336,548. This is an ornamental design for a detachable knee pad, as shown and described.

The above-referenced prior art does not disclose any protective clothing pad in the form of a patch that can be adhered to a specific target area and a variety of body parts. Also none of the prior art act as a cushion and extend the lifespan of the garment at the same time. There is a need for a permanent clothing protective clothing patch that provides cushioning protection which can be precisely placed by the user and protects the underlying garment.

SUMMARY OF THE INVENTION

A primary object of the present invention is to provide a protective clothing patch that will overcome the shortcomings of the prior art by providing a protective clothing patch that can be effectively used on elbows, knees, shins, shoulder, buttocks, or any body part area because of its targeted exact and precise placement. The protective clothing patch of the present invention is a light weight cushioned patch for protection of the elbows, knees, shins, shoulders, buttocks or any body part. The protective clothing patch has impact absorption properties targeted for at risk body parts and areas of constant use and contact with hard surfaces. It protects and extends the lifespan of the garment from wearing out.

The protective clothing patch provided is manually adhered by the user to the area of clothing of choice which covers an area of high risk of impact with the ground or hard objects. The inner impact area is a cushion member of high-impact absorption material comprised of open cell polymer, parabolic in shape to contour to the shape of knees, elbows, shins, shoulder or buttocks. The outer sheath is made of light weight, flexible and durable nylon material extends beyond the perimeter of the cushion member by one inch to one and one-half inches ensuring a more than adequate contact surface for adhering the sheath to the exterior area of the clothing. The outer sheath resists abrasive injury and tears. This patch provides cushioning to the body part and protection to the garment from the hard surfaces.

The ability to have exact placement of the patch onto the area of high risk for impact is very important. Many of the existing knee pads and protective gear do not allow targeted permanent placement. When a workman, child or gardener is required to carry around a temporary or removable pad or gear they tend to forget to use it or fail to use it as needed. Clothing that has pre-attached padding in a particular location does not give adequate protection as each individual is built differently. The prior art type padding may not necessarily line up with the elbow, knee, shin, shoulder or buttocks of each person in exactly the same way. The present invention provides a custom-made article of clothing with precision protection for the user's at risk body part due to its ability to be ironed on the exact target area determined by the user. Additionally, the parabolic shape allows placement on various body parts and it remains in place even after extended use. The exterior placement of the patch protects high use areas of garment.

The workers who use protective patches on an every day basis will tend to decrease injuries to target areas and therefore decrease sick days, injuries, workers compensation claims and accumulative long term damage which could lead to disability over the long term. The present invention provides an invaluable tool to employers. The workers will have a permanent protective patch on their clothing that protects the target areas and saves the work uniform from usual wear and tear.

Another object is to provide a protective clothing patch having a wide flat contact surface for a more even weight distribution to increase protection to a body part of a person. When kneeling on the floor or ground, or when falling during a sporting event, or sitting while gardening or working each target area is protected by the cushioned pad.

An additional object is to provide a protective clothing patch with adhesive to attach, in a target area, on a pair of pants, a shirt, sweatshirt, or the like clothing. An additional object is to provide the convenience of a protective clothing patch with adhesive to iron onto any area of the desired article of clothing (pants, shirt, jacket or uniform).

Another object is to provide a protective clothing patch that is parabolic in shape to allow versatility to the use on variety of body parts. A further object is to provide a protective clothing patch that is simple and easy to use.

A still further object is to provide a protective clothing patch that is economical in cost to manufacture.

Another further object is to provide a protective clothing patch that extends the lifespan of the garment by preventing usual wear and tear in high impact areas.

And another further object is to provide a protective clothing patch that is durable, flexible and lightweight for comfortable use on any body part.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
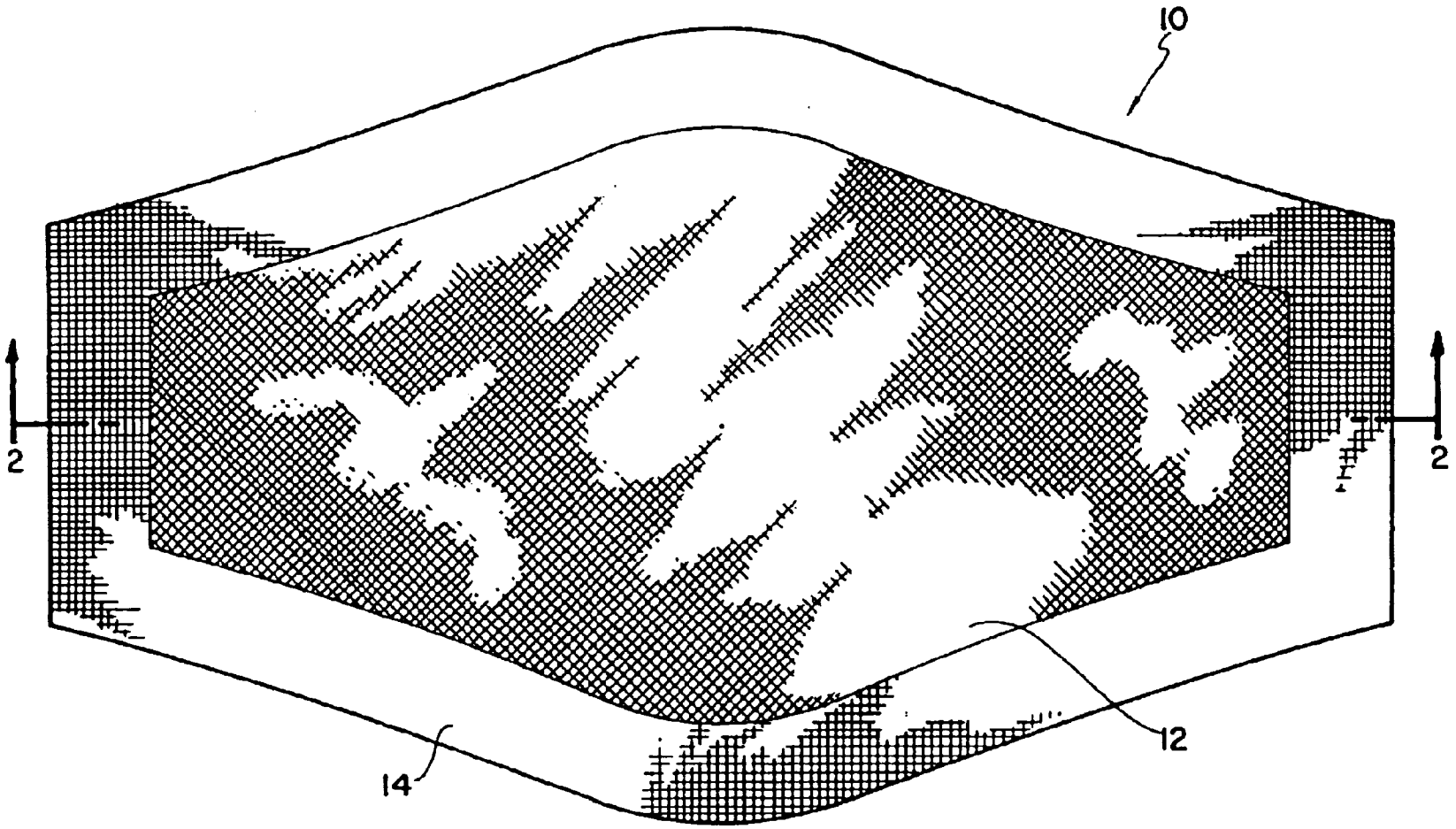
FIG. 1 is a perspective view of the protective clothing patch from the underside showing the cushion member as attached to the outer sheath.
Figure 2:
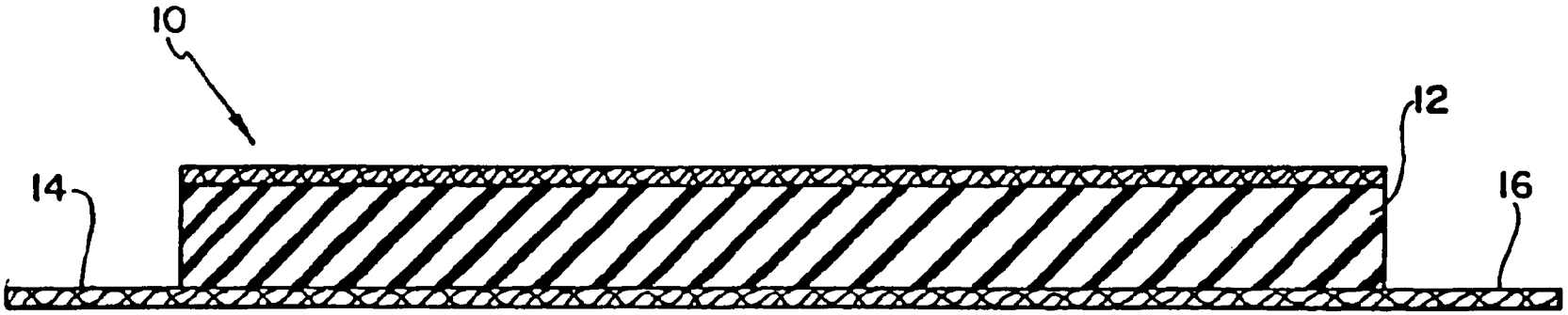
FIG. 2 is a cross sectional longitudinal view a1 to a2 of FIG. 1 of protective clothing patch, shown on a standing person wearing pants.

Turning now descriptively to the drawings, in which similar reference characters denote similar elements throughout the several views, FIGS. 1 and 2 illustrates a protective clothing patch 10 for cushioning a knee, elbow, shin, shoulder or buttocks of a person wearing a shirt or pair of pants. The protective clothing patch 10 comprises a cushion member 12 being a high impact material of a parabolic shape. An outer sheath (14) is also a parabolic shape and relatively larger than the cushion member (12). A permanent adhesive is applied between the upper side of the cushion member (12) and the underside of the outer sheath (14) at all contact points so they are permanently joined prior to use. A heat activated adhesive (16) is applied to the underside of the cushion member (12) and outer sheath (14) for attaching the protective clothing patch (10) to an article of clothing. The permanent adhesion protects and extends the life of the garment by preventing the usual wear and tear on the body part area.

The cushion member 12 is made from an open-cell polymer, which is extremely lightweight, having a high shock absorption capacity, having elastic rebound with shape retention, and a tough exterior being non-permeable to water and oil. The adhesive (16) will be activated by heat such as an iron so that the protective clothing patch is permanently attached to the article of clothing in a target area selected by the user.

Figure 3:
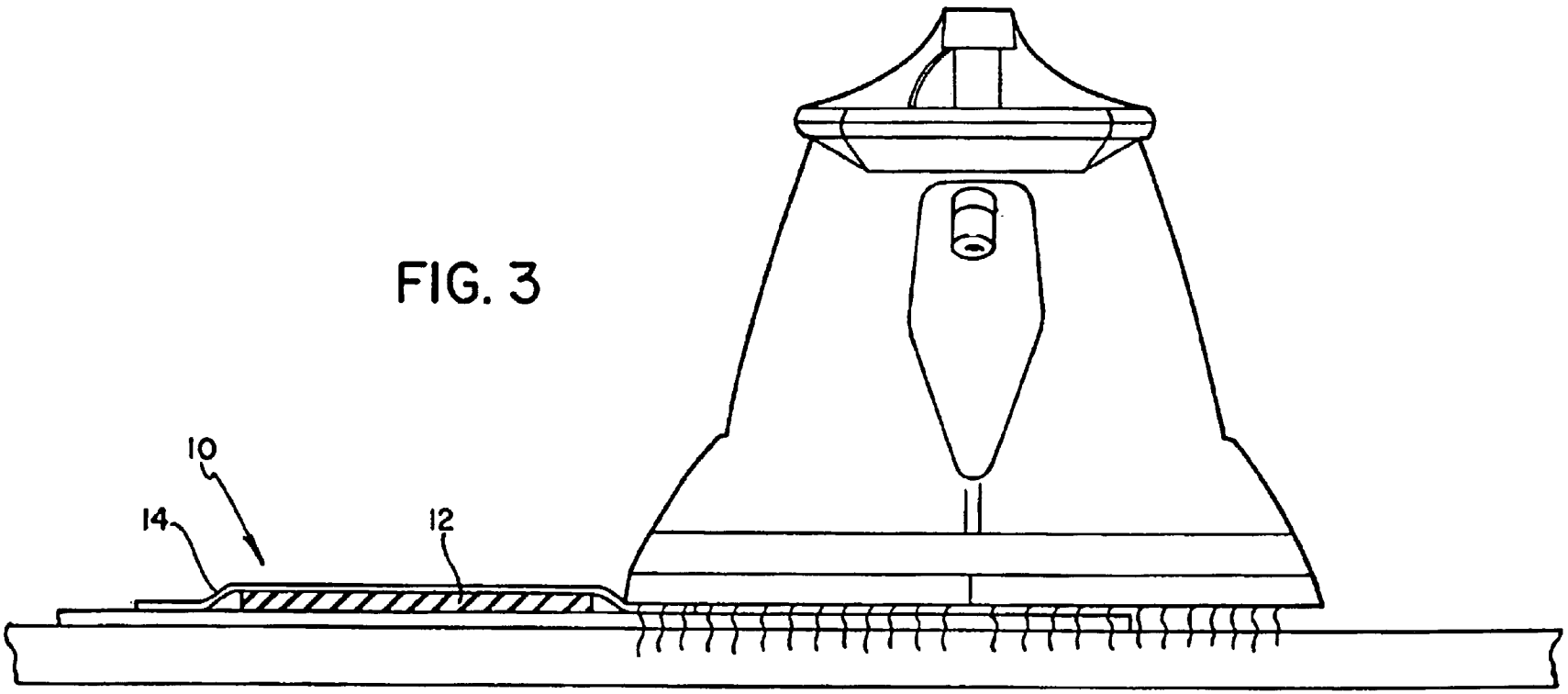
FIG. 3 is a view of the protective clothing patch shown being ironed onto a layer of clothing.

FIGS. 2 and 3 illustrate how to set each protective clothing patch 10 in the right place on the article of clothing. The underside of the outer sheath (12) having the heat activated adhesive (16) is placed against the article of clothing and positioned to cover a person's knee cap, elbow, shin, shoulder or buttocks. A heating device such as an iron is placed against the top side of the outer sheath (12) to activate the heat activated adhesive. The iron is removed and the protective clothing patch (10) is permanently in place. As the knee starts to bend, the roundness of the person's own knee cap will align the protective clothing patch 10, so that when the knee is fully bent the protective clothing patch 10 is in exactly the right place. The parabolic shape allows for the patch to be placed over any body part and remain in place even with extended use.

Figure 4:
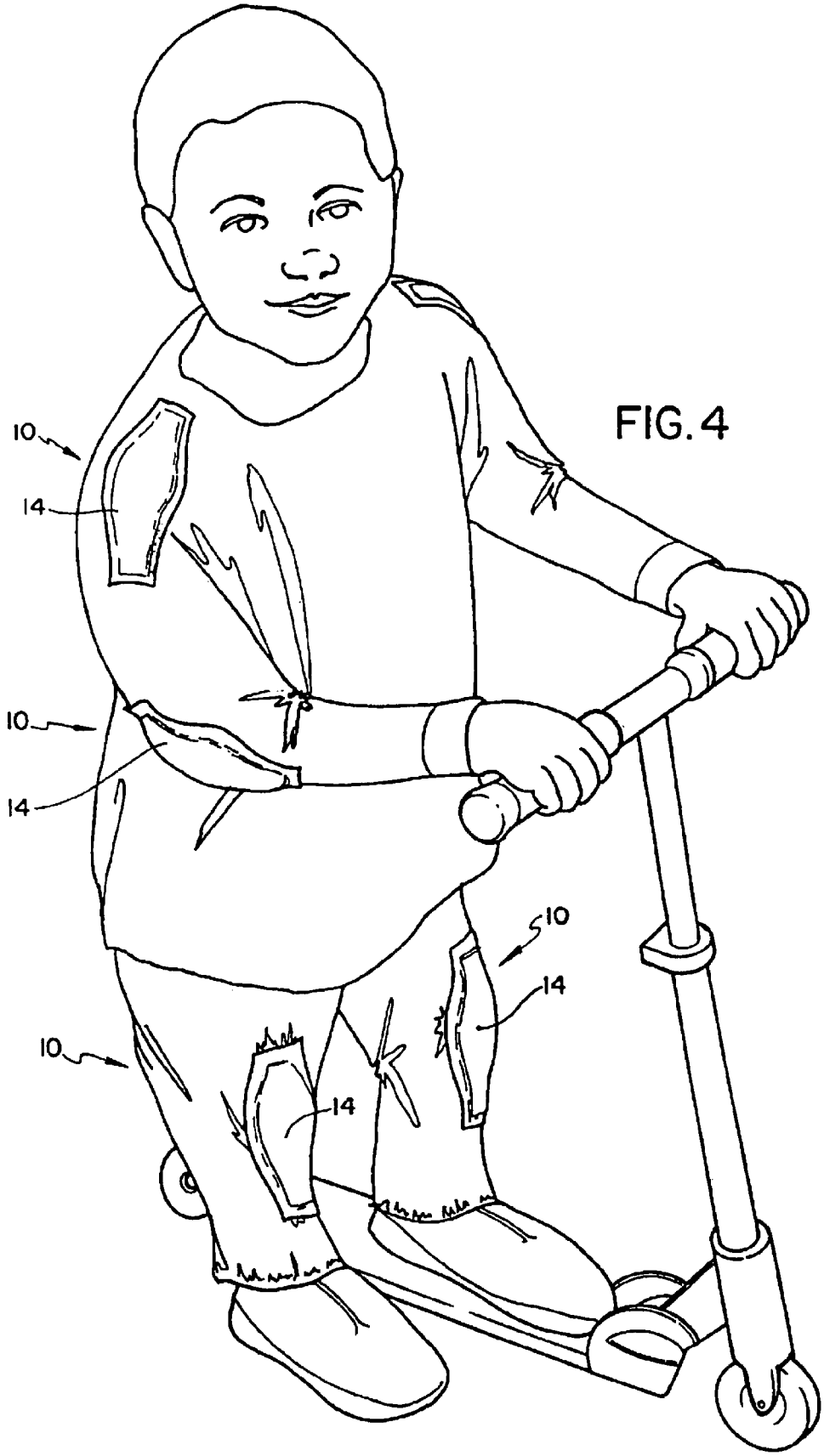
FIG. 4 is a view of the protective clothing patch shown on a person's elbow, shoulder and knees.
Figure 5:
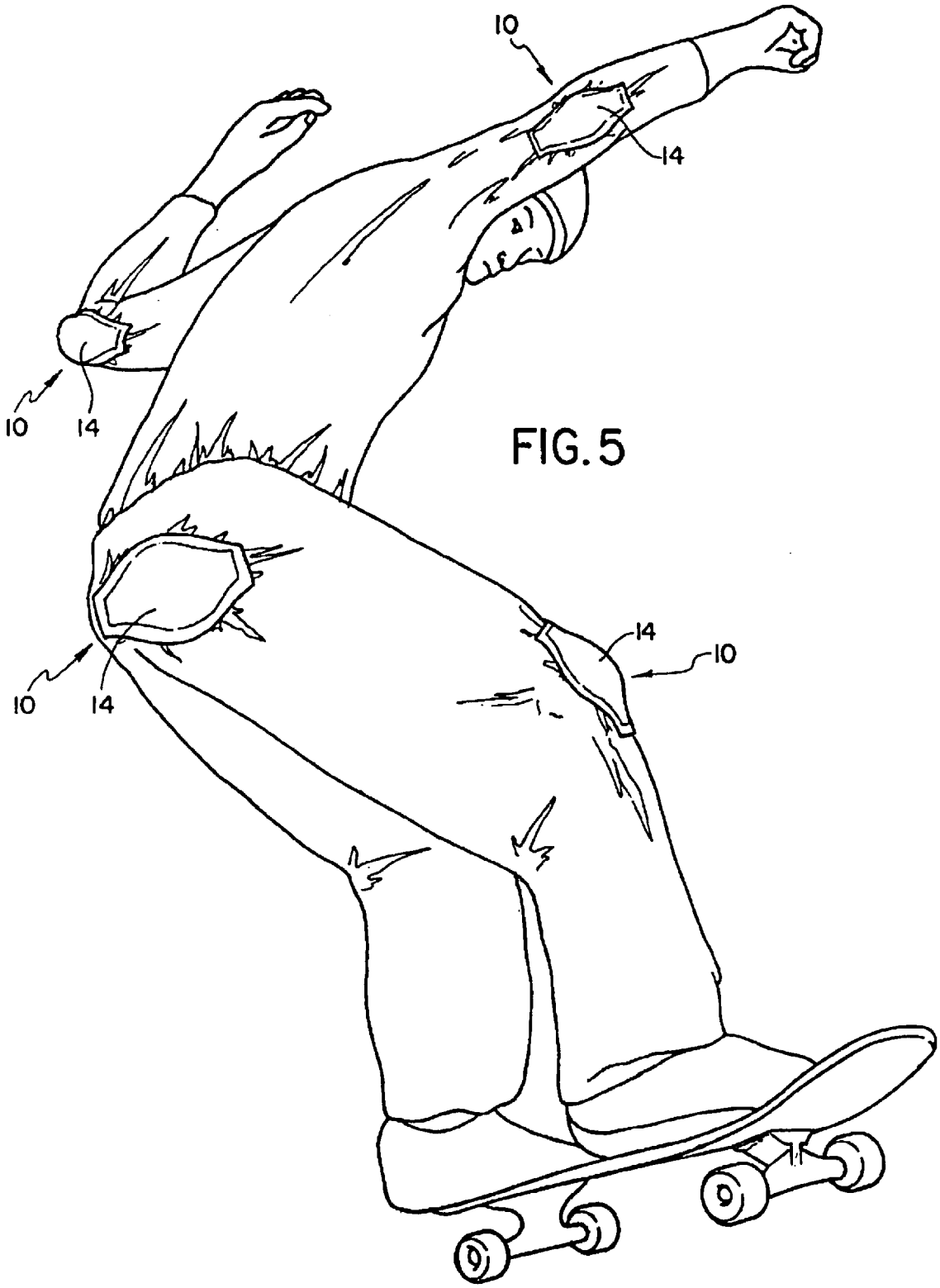
FIG. 5 is a view of the protective clothing patch shown on a person's buttocks, knee and elbows.

FIGS. 4 and 5 illustrate that the protective clothing patch (10) can be placed on the shins, elbows, buttocks or even the shoulder of a user. A sports enthusiast can select any target area to apply the protective clothing patch. The protective clothing patch is shown on the article of clothing and positioned over the buttocks of a person. This insures that, as the person bends to sit, the roundness of the person's buttocks will align the protective clothing patch 10, so that when the buttocks is fully bent the protective clothing patch is exactly in the right place. The protective clothing patch is also shown placed on the article of clothing and positioned over the elbow of a person. This insures that, as the person bends the elbow, the roundness of the elbow will align the protective clothing patch 10, so that when the elbow is fully bent the protective clothing patch is exactly in the right place. This is true for any body part that the patch protects.

As the patch covers high impact areas of the user, it protects and extends the lifespan of the garment by preventing the usual wear and tear on the garment.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A protective clothing patch is provided to provide comfort to body parts of high impact such as elbows, shoulders, knees, shins, buttocks of a user comprising a parabolic shaped outer sheath having an upper surface and an under surface; a parabolic shaped open cell polymer cushion member relatively smaller in size than said outer sheath having an upper surface and an under surface; an adhesive on the upper surface of the cushion member that permanently attaches the upper surface of the cushion member to the under surface of the outer sheath; a heat activated adhesive applied to the under surface of the cushion member and on the under surface of the outer sheath, which is not in contact with the cushion member; wherein heat is applied to the upper surface of the outer sheath to activate the heat activated adhesive to permanently adhere the protective clothing patch to an exterior surface of an article of clothing at a predetermined target area.

2. A protective clothing patch as claimed in claim 1 further comprising an outer sheath that is lightweight and durable.

3. A protective clothing patch as claimed in claim 1 wherein the protective clothing patch is adhered to the exterior of clothing to protect the clothing from wearing out or tearing.

* * * * *